US006784758B2

(12) United States Patent
Edwards et al.

(10) Patent No.: US 6,784,758 B2
(45) Date of Patent: Aug. 31, 2004

(54) DEGENERATE MODE COMBINER

(75) Inventors: David John Edwards, Oxon (GB); Alan Peter Jenkins, Oxon (GB); Yit Aun Lim, Oxford (GB)

(73) Assignee: ISIS Innovation Limited, Oxford (GB)

( * ) Notice: Subject to any disclaimer, the term of this patent is extended or adjusted under 35 U.S.C. 154(b) by 32 days.

(21) Appl. No.: 09/914,947

(22) PCT Filed: Dec. 3, 2000

(86) PCT No.: PCT/GB00/00861

§ 371 (c)(1),
(2), (4) Date: Dec. 31, 2001

(87) PCT Pub. No.: WO00/54364

PCT Pub. Date: Sep. 14, 2000

(65) Prior Publication Data

US 2002/0158706 A1 Oct. 31, 2002

(30) Foreign Application Priority Data

Mar. 9, 1999 (GB) ..... 9905411

(51) Int. Cl.[7] ..... H01P 5/12
(52) U.S. Cl. ..... 333/128; 333/127; 333/33
(58) Field of Search ..... 333/128, 125, 333/127, 33, 238

(56) References Cited

U.S. PATENT DOCUMENTS

| | | | | |
|---|---|---|---|---|
| 2,420,354 A | | 5/1947 | Carter et al. | 178/44 |
| 3,619,787 A | * | 11/1971 | Salzberg | 455/327 |
| 4,175,257 A | * | 11/1979 | Smith et al. | 330/287 |
| 4,234,854 A | | 11/1980 | Schellenberg et al. | 330/286 |
| 4,263,568 A | * | 4/1981 | Nemit | 333/127 |
| 4,371,845 A | * | 2/1983 | Pitzalis, Jr. | 330/277 |
| 4,525,690 A | * | 6/1985 | De Ronde | 333/116 |
| 4,562,409 A | * | 12/1985 | Saito et al. | 330/286 |
| 4,590,446 A | * | 5/1986 | Hsu et al. | 333/125 |
| 4,598,254 A | * | 7/1986 | Saito et al. | 330/286 |
| 4,644,303 A | * | 2/1987 | Jachowski et al. | 333/134 |
| 4,812,782 A | * | 3/1989 | Ajioka | 330/286 |
| 4,825,175 A | * | 4/1989 | Tsuda et al. | 330/286 |
| 4,853,650 A | | 8/1989 | Bowling et al. | 330/287 |
| 4,956,614 A | * | 9/1990 | Baril | 330/286 |

FOREIGN PATENT DOCUMENTS

| | | |
|---|---|---|
| FR | 2 263 612 | 10/1975 |
| GB | 2 326 286 | 12/1998 |

OTHER PUBLICATIONS

M. Abouzahra et al. "Multiple–Port Power Dividers/Combiners Circuits Using Circular Microstrip Disc Configuration", XP002181722, *IEEE–MTT–S International Microwave Symposium–Digest*, pp 211–214, Jun. 1997.

(List continued on next page.)

*Primary Examiner*—Robert Pascal
*Assistant Examiner*—Kimberly Glenn
(74) *Attorney, Agent, or Firm*—Foley & Lardner LLP

(57) ABSTRACT

A wave device for supporting electromagnetic waves, the device including a first pair of inputs for setting up a first standing wave therebetween a second pair of inputs for setting up a second standing wave therebetween and positioned such that the input signal of each of the first and second pairs of inputs is unaffected by the other of the first and second pairs of inputs and an output positioned so as to receive power from both the first and second standing waves.

11 Claims, 3 Drawing Sheets

OTHER PUBLICATIONS

"Patent Abstracts of Japan" vol. 010, No. 319 (E450), Oct. 30, 1986, JP 61 128604, Hitachi Ltd., Jun. 1986.

Gupta et al. "Analysis and Design of Four–Port and Five–Port Microstrip Disc Circuits", XP–002181724, *IEEE Transactions on Microwave Theory and Techniques*, vol. 33 No. 12, pp. 1422–1427, 1525, Dec. 1985.

E Belohoubek et al., "30–Way Radial Power Combiner for Miniature Gas Fet Power Amplifiers", P002181723, *IEE–MTT–S International Microwave Symposium–Digest*, pp. 151–518, Jun. 1986.

"Patent Abstracts of Japan", vol. 10 No. 065 (E388), Mar. 1986, JP 60 216602A Nippon Dengiyou Kousaku KK), Oct. 1995.

Boifot, Anton M., "Classification of Ortho–Mode Transducers", *European Transactions on Telecommunication and Related Technologies*, vol. 2, No. 5, pp. 503–510, (Sept.–Oct. 1991).

* cited by examiner

DEGENERATE MODE COMBINER

The present invention relates to a wave device for combining power at microwave/radio frequencies.

Solid state devices are low power and, with increasing frequency, the power output from a single solid state device decreases rapidly. In many applications, the power levels that are required exceeded the capability of any single device or amplifier. It is therefore desirable to extend the power level by combining techniques to take advantage of the many desirable features of solid state devices, such as small size and weight, reliability and performance in a broader range of applications. Many types of power combiner are known and these have applications in many areas, such as cellular radio base stations, broadcast services, earth stations, radar and antennas.

A significant problem with known power combiners occurs upon failure of one of the input power amplifiers.

FIG. 1 of the accompanying drawings illustrates a microstrip layout of a 2-way Wilkinson combiner. This combiner performs adequately as long as the power amplifiers on both of its inputs are functioning correctly. However, this combiner requires the impedance at both inputs to be balanced. If the power amplifier at one input fails, then power from the other input is out of balance and performance drops significantly. Indeed, it can become very difficult, if not dangerous, to attempt to replace the failed power amplifier, since disconnection of the failed power amplifier from its input may result in transmission of waves from that input to the service engineer.

For previously known methods of power combinations, the following efficiencies are available for a 2-amplifier arrangement under fully working conditions and with a single amplifier failure:

Wilkinson:
- No failure: 90%,
- Single amplifier failure 40%;

Directional Coupler:
- No failure: 90%,
- Single amplifier failure 39%;

N-way hybrid combiner:
- Single amplifier failure: 25%;

Planar:
- Single amplifier failure: 25%.

Description of the N-way hybrid combiner and the planar device may be found respectively in A. A. M. Saleh, "Improving the Graceful-Degradation Performance of Combined Power Amplifiers" *IEEE Trans. Microwave Theory Tech*, Vol. MTT-28, No. 10, October 1980, pp 1068–1070 and I. J. Bahl and . Bhartia, *Microwave Solid State Circuit Design*, Wiley, N.Y., 1988.

Hence, it is an object of the present invention to provide a combiner of improved sufficiency, particular upon failure of an input amplifier.

According to the present invention there is provided a method of combining electromagnetic waves comprising:

arranging a first pair of inputs across a wave device so as to set up a first standing wave therebetween;

arranging a second pair of inputs across the wave device so as to set up a second standing wave therebetween such that the input independence of each of the first and second pairs of inputs is unaffected by the other of the first and second pairs of inputs; and arranging an output at a position on the wave device so as to receive power from both the first and second standing waves.

According to the present invention there is provided a wave device for supporting electromagnetic waves, the device including:

a first pair of inputs for setting up a first standing wave therebetween;

a second pair of inputs for setting up a second standing wave therebetween and positioned such that the input signal of each of the first and second pairs of inputs is unaffected by the state or impedance of the other of the first and second pairs of inputs; and an output positioned so as to receive power from both the first and second standing waves.

In this way, since the inputs to the wave device are arranged in pairs, any failure results in a symmetric loss of input to the wave device, furthermore, since pairs of inputs are positioned on the device such that they have no effect on the other inputs, any failure will not affect the balance of the other inputs. Failure of one pair of inputs merely results in a corresponding loss of power at the output.

An additional advantage is that, since each pair of inputs receives no power from the other pair of inputs, upon failure of an input amplifier, that input amplifier can be disconnected and replaced without any danger of transmission from the disconnected input.

The wave device may include a conductive plate for supporting the first and second standing waves. The plate may be mounted parallel to a grounded structure and separated from the grounded structure by a dielectric. In this way, the device may be constructed as a microstrip structure. Such structures are well known and may be easily produced by the skilled person.

The plate may be a polygon having an even number of sides with each respective pair of inputs connected across an opposing pair of sides. Alternatively, the plate may be circular, such that each respective pair of inputs is connected to the plate across a diameter of the plate.

In this way, the invention may be carried out with the pairs of inputs angularly displaced around the perimeter of the plate.

Preferably, the output is positioned at substantially the antinode of the device which may be preferably the centre of the device.

In this way, the output may easily receive power from both of the standing waves.

Preferably the device further comprises first and second dividers for providing the first and second pairs of inputs from first and second signal sources. In this way, power from a single signal source is evenly divided between a pair of inputs, such that power is input across the device evenly.

The device may comprise one or more additional pairs of inputs for setting up additional respective standing waves.

In this way, the combiner may combine three or more signals, with each signal being independent of the other signals and not effecting the input impedance.

The wave device may also be used as a splitter by providing a power input at the output of the wave device and receiving divided power output from the pairs of inputs.

The invention will be more clearly understood from the following description, given by way of example only, with reference to the accompanying drawings, in which.

An embodiment of a 2-way combiner will now be described. The wave device will be referred to as a degenerate mode combiner, or DMC, since it makes use of resonant modes of the device and provides graceful degradation performance upon input amplifier failure.

Figure 2:
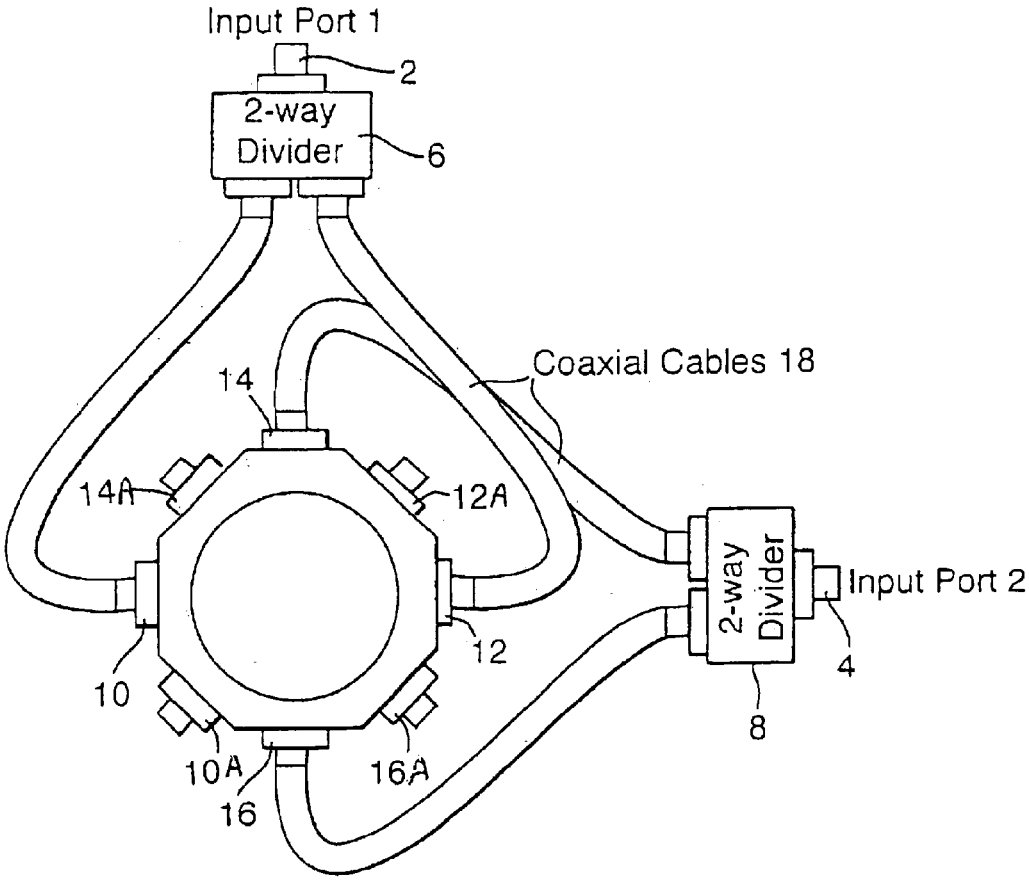
FIG. 2 illustrates an embodiment of the present invention.
Figure 3:
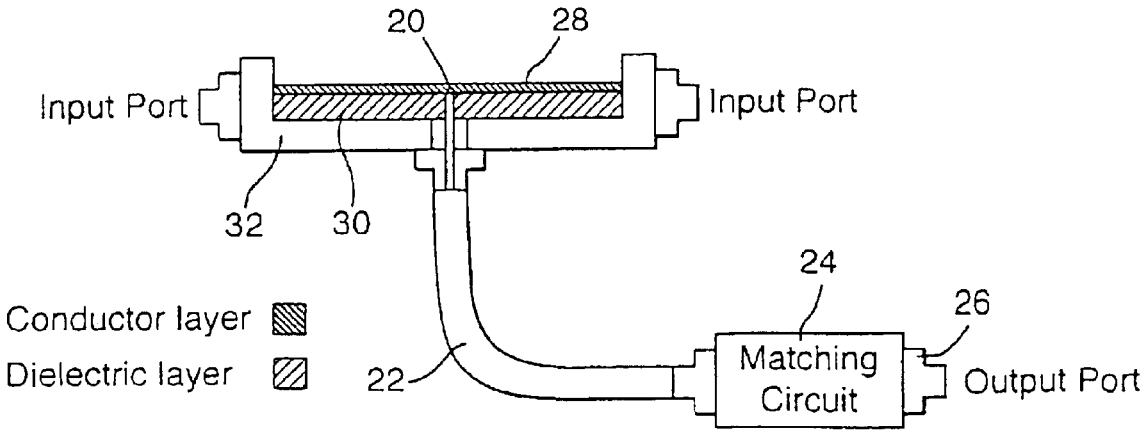
FIG. 3 illustrates a cross-section through the embodiment of FIG. 2.

The basic input structure of the DMC is illustrated in FIG. 2 and the corresponding output structure is illustrated by the cross-section of FIG. 3.

Figure 1:
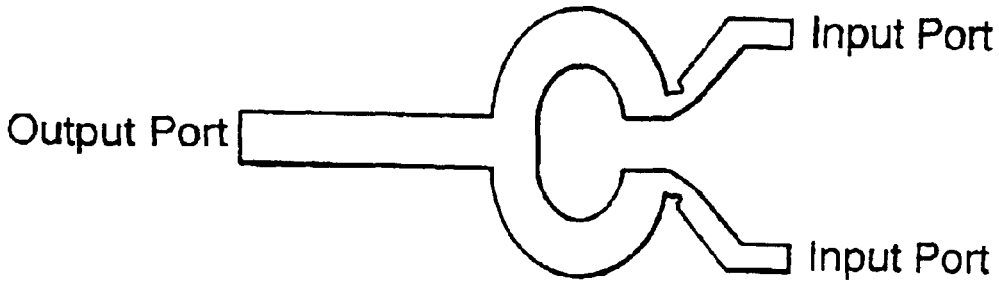
FIG. 1 illustrates a known 2-way Wilkinson combiner.
Figure 4:
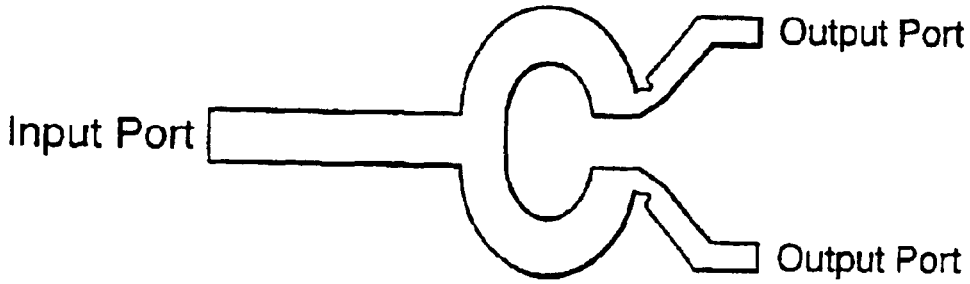
FIG. 4 illustrates the microstrip layer of a divider.

Output from two power amplifiers are provided respectively to the input ports 2 and 4 of two 2-way dividers 6 and 8. The 2-way dividers 6 and 8 may be of any known design, for instance a 2-way Wilkinson divider. The microstrip layout of such a 2-way Wilkinson divider is illustrated in FIG. 4. However, it is not necessary to use such dividers.

The two outputs of the first divider 6 are provided as a pair of inputs 10,12 to the DMC and the two outputs of the second divider 8 are provided as a pair of second inputs 14,16 to the DMC. As illustrated, the wave signals are transmitted from the dividers to the DMC via coaxial cable 18, though, of course, any other suitable wave guide could also be used.

In the 2-way combiner of this embodiment, the two pairs of inputs 10,12 and 14,16 are offset around the DMC by 90°. As will be described later, this results in the first pair of inputs 10,12 setting up a first standing wave across the DMC in one direction and the second pair of inputs 14,16 setting up a second standing wave across the DMC in a perpendicular direction. By choosing appropriate frequencies, dimensions and properties of the DMC, it is also arranged that the standing wave produced by one of the pair of inputs has no effect on the other pair of inputs. In this way, failure or disconnection of one of the power amplifiers supplying its power input will have no effect on the other input.

Referring to FIG. 3, it will be seen that an output 20 from the DMC is taken from the centre. In this embodiment, the DMC is arranged such that the waves from both of the pairs of inputs create an anti-node at the centre of the DMC. Thus, the output 20 is formed from a combination of the signals input from both pairs of inputs 10,12 and 14,16, even though one pair of inputs does not provide any power to the other pair of inputs.

The output signal from the DMC may be transferred using a coaxial cable 22 or any other suitable wave guide. Furthermore, a matching circuit 24 may be used to provide an output port 26 for further signal transmission.

Figure 5:
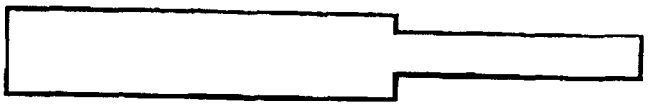
FIG. 5 illustrates a microstrip layer of a matching circuit.

Any suitable known matching circuit may be used. However, a typical microstrip layout for the matching circuit is illustrated in FIG. 5.

As illustrated in FIG. 3, the DMC is preferably constructed as a microstrip structure. In particular, it includes a conductor plate 28 supported on a dielectric 30, in an earthed support structure 32. Any suitable material may be used for the conductor 28, though it is preferred to use copper or a super conductor. It is considered to use copper having a thickness of approximately 17 $\mu$m. However, since any field is to be carried in a skin depth of only a few $\mu$m, it is sufficient to use a thickness of approximately twice the skin depth.

Any suitable material may be used for the dielectric 30. Indeed, if the plate 28 is appropriately supported, for instance by means of its connecting pins, then the dielectric 30 may be a gas, such as air, or indeed free space.

It is also contemplated to base the device on Gallium Arsenide or such like and thereby allow production using integrated circuit techniques.

As illustrated, the output 20 is taken through the dielectric and also through and insulated from the support structure 32. Although not illustrated, a similar arrangement is provided for the inputs. These connect to the periphery of the plate 20, whilst being insulated from the support structure 32. Any ground line of the wave guides for the inputs, for instance the shielding of a coaxial cable, may be connected to the support structure 32.

The embodiment discussed above used a DMC of circular structure having two pairs of inputs and a centrally mounted output. However, as will be apparent from the following, such a structure is not necessary for application of the present invention. For instance, when using two pairs of inputs with perpendicular standing waves, the DMC, or at least the plate 28 in the microstrip embodiment, can be square with inputs mounted centrally along respective edges of the square.

Referring to FIG. 2, a broader description of the principles behind the present invention will be described.

By applying a signal to both inputs 10,12 across a device, it is possible to set up a standing wave across the device. The nature of that standing wave will vary according to the frequency or the input signal, the distance between the two inputs and the properties of the wave device. In particular, the resonant frequency between the inputs will depend on the distance between them and, for the embodiment of FIG. 3, the dielectric constant of the dielectric 30. For the same resonant frequency, the size of the device will be reduced as the dielectric constant increases.

When a standing wave exists between the inputs 10,12, the signal which can be detected at the periphery of the device varies around the periphery. When the standing wave between the inputs 10,12 is at the fundamental frequency, then the detected signal at the periphery of the device reaches a minium of substantially zero at a position halfway between the inputs 10 and 12. Thus, for a 2-way combiner, it is sufficient to connect a second pair of inputs perpendicular to the first pair of inputs. It will be noted that, in this case, with two perpendicular standing waves, it is therefore sufficient for the device to be square.

By changing the operating frequency of the device or alternatively changing the size or the properties of the device, it is possible to set up different standing waves. In particular, it is possible to set up standing waves such that the detected signal at the periphery reaches substantially zero at multiple points around the periphery. In this way, it is possible to arrange three or more pairs of inputs around the periphery to provide a three or more-way combiner as shown in FIG. 2, which includes additional pairs of inputs 10A, 12A, 14A and 16A. Indeed, the device may then be any even sided polygon such as a hexagon, octagon etc. It should be appreciated that the device can be arranged to have multiple zero points around its periphery and yet still be used as only a 2-way combiner. However, when the device is used with more zero points around its periphery, the angular sensitivity of the positions of the inputs is increased, such that manufacturing tolerances must also be increased.

It will be appreciated that it is also possible to set up appropriate standing waves in the device without providing the inputs at the periphery. In particular, it is possible to connect pairs of inputs to the device at various positions within the periphery, for instance connected to the device in a similar way to the output. The positioning of those inputs is determined according to the standing waves set up in the device.

In order to further improve separation between respective pairs of inputs, it is also possible to provide gaps or slots in the device positioned at points of zero signal.

As another alternative, it is possible to provide an asymmetric device, such that standing waves of different frequencies are set up in different directions and, hence, enabling signals of different frequencies to be combined at the output.

EXAMPLES

Figure 6:
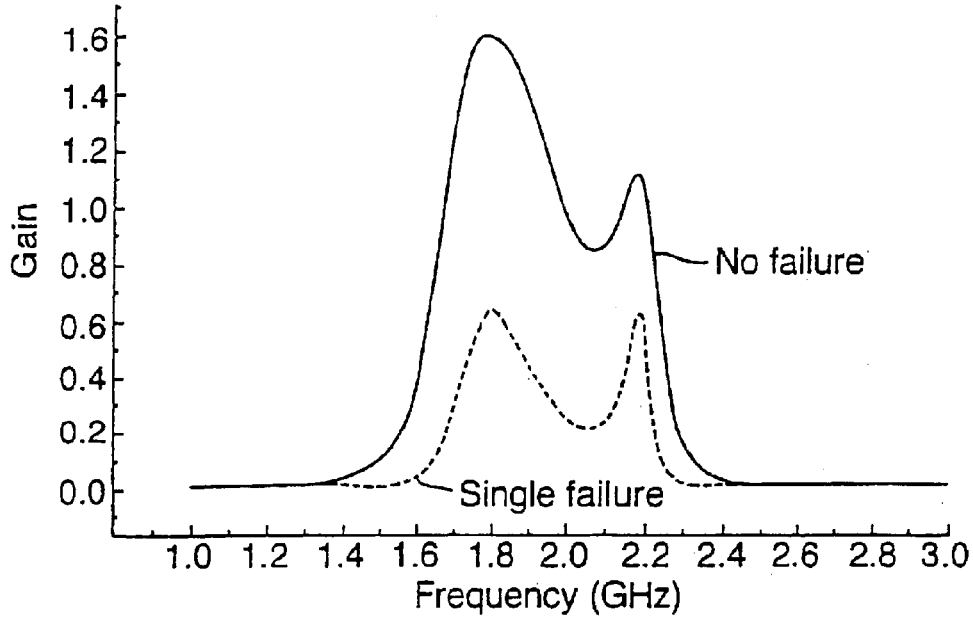
FIG. 6 illustrates the frequency response of an embodiment of the present invention with both amplifiers working and with a failed amplifier.
Figure 7:
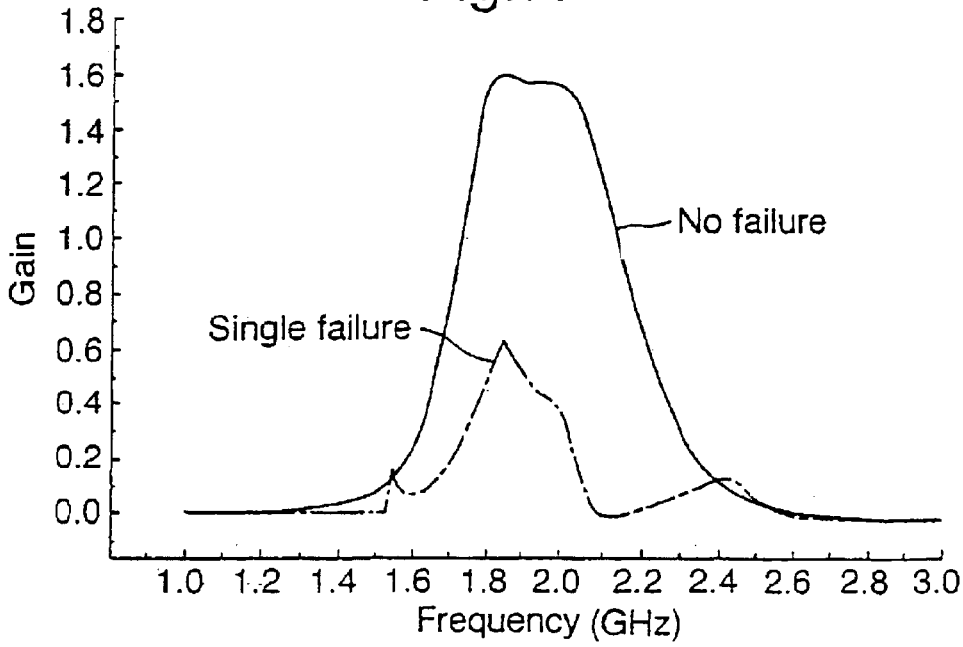
FIG. 7 illustrates a frequency response of an embodiment of the present invention with both amplifiers working and with a failed amplifier.

Two DMCs were designed with approximately similar specifications. They both had centre frequencies of 1.8 GHz and operational band widths of 15 MHz. The DMCs utilised 2-way and 4-way Wilkinson dividers respectively so as to analyse the effects of varying N, the number of outputs from the Wilkinson divider. DMCs were initially simulated with both amplifiers working and then with one of the amplifiers failing. A failed amplifier was defined according to the worse case, namely (i) zero output power and (ii) the impedance of the failed amplifier, as seen from the divider, ranging from zero to infinity i.e. anything between short circuit to ground and an open circuit. The results of the test are illustrated in FIGS. 6 and 7. The output power from a working amplifier is one unit and the results obtained include the losses incurred by the Wilkinson divider, which has an efficiency of 90%.

Referring to FIG. 6, using a 2-way Wilkinson divider for the first stage and a centre frequency of 1.8 GHz, it will be seen that, for both amplifiers working, the total combining efficiency at the centre frequency was 80%, with the worst efficiency within the operational band width being 78%. Similarly, for a single amplifier failure, the total combining efficiency at the centre frequency was 63% and the worst efficiency within the operational band width was 59%.

For the second case, illustrated in FIG. 7 utilising a 4-way Wilkinson divider and a centre frequency of 1.83 GHz, it will be seen that for both, amplifiers the total combining efficiency at the centre frequency was 80% and the worst efficiency within the operational band width was 80% Similarly, for a single amplifier failure, the total combining efficiency at the centre frequency was 63% and the worst efficiency within the operation band width was 54%.

In conclusion, it will be seen that the simulation results obtained show that the DMC has an efficiency significantly higher than the previously mentioned combiners when one of the amplifiers fails. Although a combining disk of the DMC has an efficiency of 90%, like most combiners, it also requires a splitting stage, which reduces the total combined efficiency to 80%.

Finally, it will be noted that like other previous combiners, it will be possible to operate the DMC in the reverse direction as a splitter. For example, for the embodiments of FIGS. 2 and 3, by providing an input signal at the centre 20 of the plate 28, the output power from a signal may be evenly split between the pairs of connections 10,12 and 14,16 at the periphery.

What is claimed is:

1. A wave device for supporting electromagnetic waves, the device including:

a conductive plate for supporting electromagnetic waves;

a first pair of inputs positioned on the conductive plate for setting up therebetween a first standing wave supported by the conductive plate;

a second pair of inputs positioned on the conductive plate for setting up therebetween a second standing wave supported by the conductive plate and positioned such that the input signal of each of the first and second pairs of inputs is unaffected by the state or impedance of the other of the first and second pairs of inputs; and an output positioned on the conductive plate so as to receive power from both the first and second standing waves.

2. A wave device according to claim 1 wherein the plate is mounted parallel to a grounded structure and is separated from the grounded structure by a dielectric.

3. A wave device according to claim 2 wherein the device is constructed as a microstrip structure or a stripline structure.

4. A wave device according to claim 1, wherein the plate is a polygon having an even number of sides and each respective pair of inputs is connected across an opposing pair of sides.

5. A wave device according to claim 1, wherein the plate is circular and each respective pair of inputs is connected to the plate across a diameter of the plate.

6. A wave device according to claim 1, wherein the output is positioned at substantially the antinode of the device.

7. A wave device according to claim 1, wherein the distance between a pair of inputs equals an integer number of the wave length of the wave transmitted by the inputs.

8. A wave device according to claim 1, further comprising power dividers for providing the pairs of inputs from the signal sources.

9. A wave device according to claim 1, further comprising one or more additional pairs of inputs for setting up additional respective standing waves.

10. A method of operating a wave device for supporting electromagnetic waves, the device including a conductive plate for supporting electromagnetic waves, a first pair of outputs positioned on the conductive plate for setting up therebetween a first standing wave supported by the conductive plate, a second pair of outputs positioned on the conductive plate for setting up therebetween a second standing wave supported by the conductive plate and positioned such that the signal output from each of the first and second pairs of outputs is unaffected by the state or impedance of the other of the first and second pairs of outputs; and an input positioned on the conductive plate so as to provide power to both the first and second standing waves comprising the steps of:

providing a power input at the input of the wave device and receiving divided power output from the first and second pairs of outputs.

11. A method of combining electromagnetic waves comprising:

arranging a second pair first pair of inputs across a conductive plate of a wave device so as to set up therebetween a second standing wave supported by the conductive;

arranging a second pair of inputs across the conductive plate of the wave device so as to set up therebetween a second standing wave supported by the conductive plate such that the input impedance of each of the first and second pairs of inputs is unaffected by the other of the first and second pairs of inputs; and arranging an output at a position on the conductive plate of the wave device so as to receive power from both the first and second standing waves.

* * * * *